United States Patent [19]

Tessaro

[11] 4,308,674

[45] Jan. 5, 1982

[54] SKI BOOT MADE FROM SYNTHETIC PLASTIC MATERIAL WITH SEPARATED BOOT AND LEG PORTION

[75] Inventor: Vanio Tessaro, Caerano S. Marco, Italy

[73] Assignee: Calzaturificio San Marco Di Santo Tessaro & C.S.n.c., Caerno S. Marco, Italy

[21] Appl. No.: 100,817

[22] Filed: Dec. 6, 1979

[30] Foreign Application Priority Data

Dec. 15, 1978 [IT] Italy ..... 61950/78[U]

[51] Int. Cl.[3] ..... A43B 5/04

[52] U.S. Cl. ..... 36/118; 36/120

[58] Field of Search ..... 36/117, 118, 120, 121, 36/109

[56] References Cited

U.S. PATENT DOCUMENTS

| | | | |
|---|---|---|---|
| 4,019,267 | 4/1977 | Sadler | 36/120 |
| 4,030,214 | 6/1977 | Hanson et al. | 36/118 |
| 4,143,474 | 3/1979 | Blanc | 36/120 |

FOREIGN PATENT DOCUMENTS

| | | | |
|---|---|---|---|
| 1066889 | 11/1979 | Canada | 36/120 |

*Primary Examiner*—Patrick D. Lawson

*Attorney, Agent, or Firm*—Cushman, Darby & Cushman

[57] ABSTRACT

The invention refers to a ski boot made from synthetic plastic material, with separate boot and leg portions.

The ski boot according to the invention presents a leg portion separable from the boot, comprising a part higher than the ankles and a lower part rigidly bound to the sole. The two parts of the leg portion may be built in a single piece or separately. In the latter case, the two parts are articulated to each other in the ankle region by means of pivotal pins.

The ski boot according to the invention overcomes the drawback presented by the previously known ski boots, wherein the boot's articulation area dilates as a consequence of the fore rocking of the leg portion, and thus reduces the clamping action of the boot on the skier's foot, just when the skier's leg is expected to transmit the strongest thrust to the ski, through the ski boot.

7 Claims, 3 Drawing Figures

FIG.1
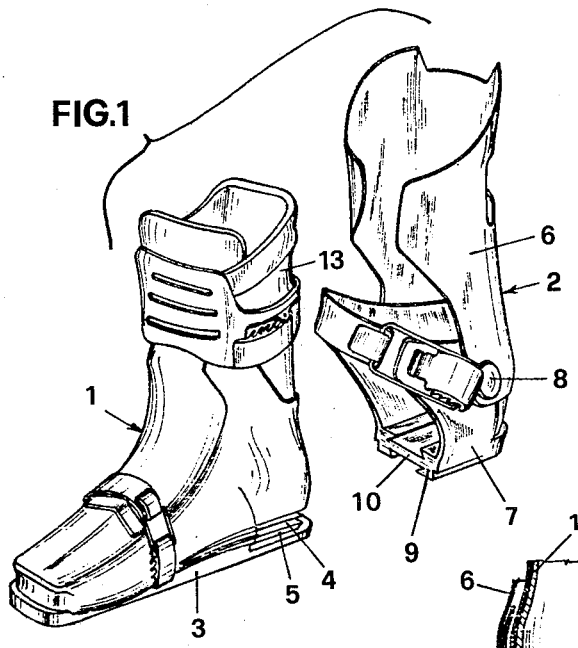
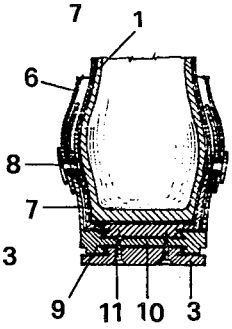
FIG.2
FIG.3
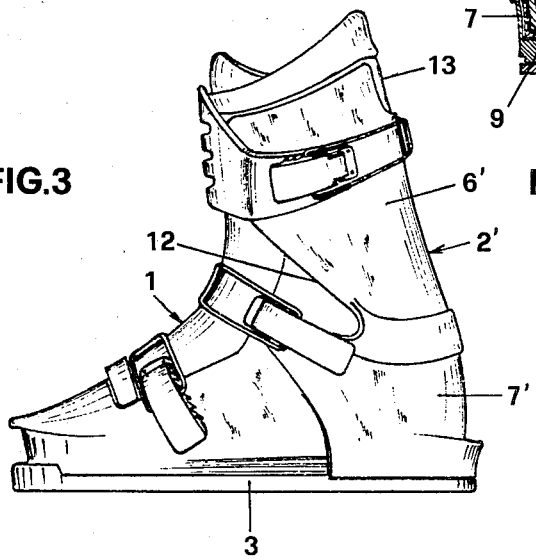

SKI BOOT MADE FROM SYNTHETIC PLASTIC MATERIAL WITH SEPARATED BOOT AND LEG PORTION

The present invention relates to a ski boot made from synthetic plastic material with separate boot and leg portions.

Ski boots are known in the prior art made from plastic material comprising a leg portion and a boot, separately produced and pivotally articulated to each other at the ankle. The pivotal articulation is generally realized through metal or plastic pivot pins, which bind the leg portion to the boot and at the same time allow a given fore and aft rocking to the skier's leg.

A drawback of such known ski boots resides in the fact that the fore rocking of the leg portion causes a dilatation of the boot, particularly striking in the articulation area. Such a dilatation reduces the clamping action of the boot on the skier's foot and is particularly detrimental as it occurs just at the moment when the skier's leg is expected to transmit the strongest thrust to the ski, through the ski boot.

To eliminate, or at least to reduce such a drawback, it has been proposed to manufacture the boots of a particularly unyielding material. This, however, is only a partial solution to the problem. In fact, as the boot becomes heavier the skier has to face a greater inconvenience in its use.

According to the invention the main drawback is eliminated with a ski boot made of plastic material, with separate boot and leg portions wherein the leg portion comprises a part higher than the ankles and a lower part rigidly bound to the sole.

Advantageously the leg portion may be made of a plastic material, stiffer than that forming the boot.

Still according to the invention the leg portion may be realized in two separate parts, articulated to each other, in the ankle region.

In an advantageous embodiment the part of the leg portion laying below the ankles fits in a corresponding seat of the boat, located immediately above the sole.

The present invention is herein disclosed and illustrated in a preferred embodiment and in a further embodiment to which, however, the invention is in no way restricted and which are given merely by way of example, in the accompanying drawings in which:

FIG. 1 is an exploded view in perspective of the ski boot according to the invention;

FIG. 2 is a partial transversal cross section of the ski boot, said section passing through the region of the ankle;

FIG. 3 is a side view of the ski boot, in a different embodiment.

The ski boot according to the invention comprises a boot portion 1 and a leg portion 2, made of plastic material following a known injection molding process. Within the boot there is a known soft inner shoe 13. The lower part of the boot 1 forms the sole 3 and is provided, in its back side, with a horizontal split 4 running immediately above the sole, from one side to the other. Such a split 4 is delimited along its side edges by a pair of opposed dovetail grooves 5.

The leg portion 2 is made of a material stiffer than that forming the boot 1, and in the embodiment illustrated in FIGS. 1 and 2, the two parts 6 and 7 are articulated to each other in the region of the ankle, by means of metal pivotal pins 8 or similar elements.

The higher part 6 of the leg portion 2 is shaped in such a way as to embrace the corresponding higher part of the boot 1 and the leg part of the soft inner shoe 13. The lower part 7, on the other hand, is shaped, in its inferior side in a way complementary to the split 4 and to the dovetail grooves 5. In particular the lower part 7 comprises in its interior section two dovetail ribs 9, complementary to the grooves 5, bound to each other through a plane plate 10, complementary to the split 4.

Once the lower part 7 of the leg portion 2 has been inserted into the seat grooves of the sole 3, the fastening of the boot 1 to the leg portion is firmly secured through screws 11.

The boot according to the invention, presents a number of advantages, with respect to the known boots having the leg portion articulated to the boot. Among them:

- it eliminates any dilation of the boot due to the fore rocking of the leg portion;
- it sets up a direct binding between the skier's leg and the sole, thus allowing higher sensitivity between the leg and the boot, despite a relative softness of the boot. It may be pointed out that in known boots, to obtain a quite rigid binding of the skier's leg to the sole, it was required that the boot be of a rigid material, which causes a great inconvenience to the skier; and
- it allows the production of soles of standard size and shape, according to the current regulations.

In the embodiment shown in FIG. 3, the leg portion 2' is manufactured in a single piece, and not in two distinct parts. However, due to the presence of two side cutouts 12, on opposite sides of portion 2' and running from the front edge to the ankles, the higher part 6' has a certain flexibility with respect to the lower part 7'.

The latter embodiment, in addition to the advantages of the prior one, offers a simpler and less expensive manufacturing procedure, due to the lower number of pieces required, and the elimination of an assembling step, and of the material required for such a step.

I claim:

1. A ski boot made of plastic material and comprising separate boot and leg portions, said boot portion including a sole to which the leg portion is rigidly and non-pivotally secured, said leg portion extending above the boot portion and being adapted to flex in response to flexure of the boot portion.

2. A ski boot according to claim 1 wherein a lower part is made of plastic material stiffer than that forming the boot portion.

3. A ski boot according to claim 1 wherein a lower part of the leg portion is received in a corresponding split in the boot portion located immediately above the sole.

4. A ski boot according to claims 1 or 3 wherein the boot portion and the leg portion are provided with joining elements, complementary to each other, to rigidly connect said portions together.

5. A ski boot according to claim 1 wherein a lower part of the boot portion is provided in its rear with a horizontal split running immediately above the sole and above a pair of dovetail grooves provided in the sole and wherein a lower part of the leg portion is provided with a pair of dovetail ribs complementary to the grooves and joined by a plane plate which is complementary to the split, said plate being received in the split and said ribs being received within the grooves to secure the leg portion to the boot portion.

6. A ski boot according to claim 1 wherein the leg portion is made of two separate parts articulated to each other by means of pivotal pins.

7. A ski boot according to claim 1 wherein the leg portion is formed as a single piece with two cutouts on opposite sides thereof running from the front edge towards a region adjacent the ankle of the wearer.

* * * * *